US006113454A

United States Patent [19]

Mitchell

[11] Patent Number: 6,113,454

[45] Date of Patent: Sep. 5, 2000

[54] AMUSEMENT CENTER FOR REAR FACING INFANT CHILD SEATS

[76] Inventor: Jerri Mitchell, 7 N. Tower Rd., Oak Brook, Ill. 60521

[21] Appl. No.: 08/438,343

[22] Filed: May 10, 1995

[51] Int. Cl.[7] ..... A63H 33/00

[52] U.S. Cl. ..... 446/227; 446/486; 446/901

[58] Field of Search ..... 446/227, 486, 446/488, 489, 490, 901

[56] References Cited

U.S. PATENT DOCUMENTS

| | | | |
|---|---|---|---|
| 2,369,804 | 2/1945 | Schoolfield et al. | 446/901 X |
| 2,532,007 | 11/1950 | Biasell . | |
| 2,822,968 | 2/1958 | Jackson . | |
| 3,316,669 | 5/1967 | Nachbar | 446/901 X |
| 3,744,435 | 7/1973 | Tracey et al. . | |
| 3,978,610 | 9/1976 | Stubbmann | 446/227 |
| 4,298,228 | 11/1981 | Zampino et al. . | |
| 4,594,072 | 6/1986 | Cowell | 446/486 X |
| 4,770,107 | 9/1988 | Miller . | |
| 4,824,168 | 4/1989 | Makoski . | |
| 4,901,901 | 2/1990 | Reitenour | 446/901 X |
| 4,968,279 | 11/1990 | Smith | 446/227 X |
| 5,188,421 | 2/1993 | Arenault . | |
| 5,195,918 | 3/1993 | Mozes | 446/227 |

*Primary Examiner*—D. Neal Muir

*Attorney, Agent, or Firm*—JoAnne Denison; Denison & Assocs, PC

[57] ABSTRACT

An amusement center for rear facing child seats consisting of a soft flexible display structure, a way of supporting the soft, flexible display structure, at least one entertainment item, and a way for attaching the entertainment item to the display structure. The amusement center provides intellectual and visual stimulation for infants ages birth to nine months. The display structure consists of a plurality of panels, each panel having a toy or similar entertainment item attached thereto. The display structure is made from cloth, vinyl, padded foam, or other flexible material to prevent trauma to the infant in case of an accident. The display structure is supported by clips or straps which hang over the back of a vehicle seat. The display structure may be supported by VELCRO® attachments to the vehicle seat. The attachable items may consist of photos or pictures, soft dolls or animals, or music boxes. The attachable items are attached to the display structure by way of snaps, magnets, VELCRO® adhesive tape, or other removable adhesives. Further, the photos or pictures may be attached to the flexible display structure by placing a photo or picture between two sheets of transparent vinyl that are attached to the display structure.

11 Claims, 1 Drawing Sheet

AMUSEMENT CENTER FOR REAR FACING INFANT CHILD SEATS

BACKGROUND OF THE INVENTION

This invention is directed to the field of vehicle entertainment devices, and more particularly, to devices used in vehicles to entertain infants.

The use of protective vehicle seats for infants is required by law in many if not all states. The use of such seats has greatly reduced the number of injuries and deaths that occur to infants riding in vehicles. However, for infants in rear facing vehicle seats, there is little or nothing in the prior art which addresses the problems associated with keeping such infants occupied or otherwise amused.

Typically, an infant faces a very boring fabric, vinyl or leather vehicle upholstery surface and might spend hours facing backwards on a long trip looking at such a surface. This is despite the fact that child psychologists now recognize a great need to provide proper audio and visual stimulation even in very young babies for proper intellectual development.

Moreover, parents are often distracted during driving and thus may be more likely to have an vehicle accident if an infant is crying in his or her vehicle seat. By placing photos in front of the infant or by providing a music box, the infant can often be entertained and distracted from crying.

U.S. Pat. No. 5,188,421, discloses an entertainment and feeding device for use by infants in vehicles. This device consists of a flexible sheet, rearward and forward fastening device, arc-shaped side portions, a food tray, and entertainment devices. This device also forms a portable carrying bag when the device is folded up. The main purpose of this device is to protect the interior of an vehicle from food products consumed by young children. This device does not address the needs of infants who are placed in rear-facing child seats.

U.S. Pat. No. 4,298,228, discloses a combination feeding tray and play table adapted to be used with a chair. This device is not used in conjunction with an vehicle and is not made of generally soft, flexible materials.

The prior art devices that are directed toward infant's needs are generally directed toward devices that function as oversized bibs, or otherwise keep a vehicle clean while an infant is eating. Nowhere in the prior art is a device directed to the entertainment and intellectual stimulation of infants who are placed in rear facing vehicle seats.

SUMMARY OF THE INVENTION

Accordingly, the problems left unsolved by the prior art are overcome by providing an amusement center for a rear facing child seat for an infant up to approximately nine months old or 20 lbs. consisting of a soft flexible display structure with removable entertainment items. The entertainment items may be attached to the display structure or attached to panels which are removably attached to the display structure. Each panel may have a removable entertainment item attached by VELCRO® strips, elastic loop, ties or pockets and the like. Both the panels and the entertainment items on the panels may be removed and replaced as the infant grows older to provide the appropriate stimulus. In addition, the display structure may be removed and used outside the vehicle.

The display structure may be attached to the vehicle seat by cloth ties which are attached to the back of the headrest. The display structure may also be attached by rigid plastic or vinyl-coated metal U-shaped brackets that hang over the back of the vehicle seat. Another method of attaching the display structure may be soft straps that are removably secured to the vehicle headrest by providing them with miniature hooks or loop fasteners commonly known as VELCRO®.

Another method of attaching the display structure to the vehicle seat may be to use VELCRO® fasteners directly upon both the display structure and the back of the vehicle seat.

The panels may be attached to the display structure with VELCRO®. The entertainment items may also be attached to individual panels by using VELCRO® strips, elastic loops, ties or pockets and the like which allow items to be removably secured. The pockets provided can either be opaque or clear, with clear pockets being especially desired when items such as pictures are used. The entertainment items may consist of photos or pictures, rattles, pacifiers, soft teethers, spinning wheels, soft dolls or animals, or music boxes that are activated by an electronic motion sensor located within.

The display structure may also be two-fold wherein the second half of the display structure is folded under the first half of the sheet and attached to the first half of the sheet by buttons, cooperating hooks or loops, snaps, cloth ties, etc. This allows twice as many entertainment items to be taken in the vehicle without the need for extra storage space. As the infant becomes disinterested with the first half of the display structure, the parent may simply unfold the second half and reattach it to the first half of the display structure.

By providing an amusement center with removably attached panels, the type and color of items may be changed by the caretaker as the infant ages.

For example, it is well known that infants 4 weeks to 3 months old can see at least several feet away, but they have little or no color vision and are generally most interested in faces, bold circles and stripes and simple shapes. Color vision begins with yellow at approximately three months and a caretaker can change the removably attachable panels at that age.

Thus it is an object of the present invention to provide a highly flexible amusement center for rear facing infant child seats.

It is another object of the present invention to provide intellectual and visual stimulation for infants ages birth to approximately nine months while seated in a rear facing vehicle seat.

It is another object of the present invention to provide an amusement center for rear facing child seats which is made from generally soft, flexible materials in order to prevent trauma to the infant in the case of an accident.

It is another object of the present invention to provide attachable panels that can be changed as the infant ages.

It is another object of the present invention to provide a wide variety of removably attached entertainment items for the visual stimulation of an infant.

It is another object of the present invention to provide a low cost and easy to manufacture amusement center for use in vehicles.

These and other objects and advantages of the present invention can be readily derived from the following detailed description of the drawings taken in conjunction with the accompanying drawings present herein and should be considered as within the overall scope of the invention.

DESCRIPTION OF THE PREFERRED EMBODIMENT

Figure 1:
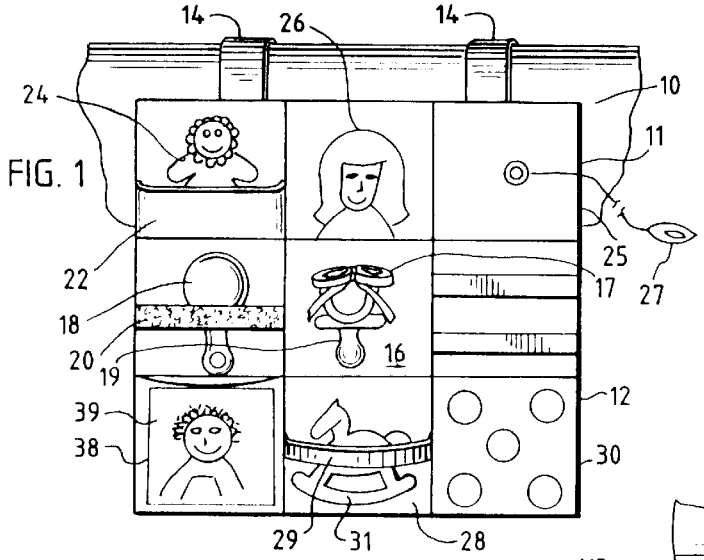
FIG. 1 is a front view of an embodiment of the amusement center for rear facing infant child seats.

FIG. 1 shows a front view of a preferred embodiment of the amusement center 10, showing display structure 11 upon which has been removably attached a variety of entertainment items. The amusement center 10 consists of a display structure and a vehicle securement means. In this particular view are shown the following types of entertainment items secured to display structure 11: panel with pocket 22 holding doll 24; music box panel 25 with pull ring 27; panel with velcro strips 20 holding rattle 18; panel with elastic loop 29 holding toy horse 31; and, printed picture panels 12, and printing 14 is done directly on display structure 11. It should be noted that printed picture panel 26 is intended to be made in bright colors for infants aged 3 months and up whereas printed picture panel 12 and printing 14 are intended to be made in black and white for the youngest babies aged birth to 3 months who have not yet developed color vision, but are interested in faces or simple black and white objects. Also shown in this view is clear photo pocket 38 into which a photograph 39 has been slipped. Photographs of faces are suitable for all ages of infants inasmuch as it has been shown that even the tiniest of infants are interested in faces.

In a preferred embodiment, the entertainment items would be attached according to their most appropriate mechanisms of attachment and would depend on the weight, material, size and other characteristics. In the case of rattles, dolls or figures, velcro strip panel 20, elastic loop panel 29, tie panel 17 or pocket panel 22 would be desirable.

A music box with pull ring 27 may also be provided inasmuch as infants are easily amused and soothed with gentle music. By providing a pull ring 27, an adult can easily grab the ring and start the music without much trouble. Of course, it would be equally as desirable to provide an electronic music box with a motion sensor that could initiate the playing of music whenever movement of the car is sensed. This would totally automate the amusement of the infant for the convenience of the driver and passengers.

In the case of pictures or photos, these may be attached by providing a clear photo pocket panel 38 which has Velcro strips attached to its back. Music boxes, motion actuated devices and the like may be placed inside removable pouches or pockets such as the pocket panel 22 shown in FIG. 1. Other similar means of attachment are contemplated as within the scope of the invention although not specifically named herein.

Figure 2:
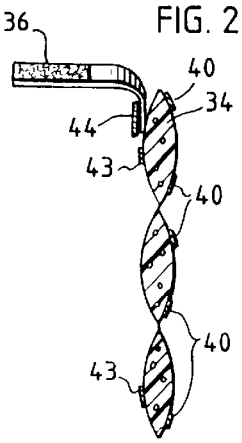
FIG. 2 is a cross-sectional view of an embodiment of the amusement center shown showing VECLRO® strip vehicle securement means extended therefrom.

In a preferred embodiment, the display structure 11 has both an outer flexible cover 30 and a base flexible cover 32 with foam 34 sandwiched therebetween, as shown in FIG. 2, wherein both are made from flexible material such as cloth or flexible plastic polymers to prevent trauma to the infant in the case of an accident and both are preferably foam filled or quilted as shown in the cross section view of FIG. 2. The flexibility also allows for the amusement center 10 containing toys and amusement items to be folded up and transported from the car to a temporary play area. This capability provides organization of the toys and provides a supply of toys available to a child while away from home. When cloth material is used for either flexible outer cover 30 or base flexible cover 32, these elements may be made from natural materials such as cotton, wool, or other natural fibers, synthetic materials such as polyesters, rayons or other synthetic fibers, or combinations of natural and synthetic fibers. Some examples of the flexible polymeric materials from which the amusement center 10 may be made include but are not limited to elastomers made from acrylics, elastomeric alloys, polyamides, polyesters, polyethylenes, polyolefins, polyphenylenes, polypropylenes, polystrenes, polyurethanes, silicones, thermoplastic elastomers, vinyl based resins, co-polymers, thermosets, compounds, or composites which are readily available in the marketplace.

The size of the amusement center 10 may vary from the size of a single photograph up to two or three feet on a side in order to provide stimulation for the entire field of vision for a small child or infant.

Figure 3:
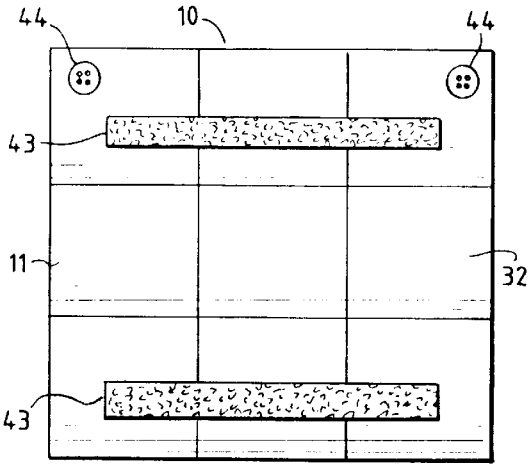
FIG. 3 is a back view of the amusement center showing two alternative vehicle attachment means.
Figure 4:
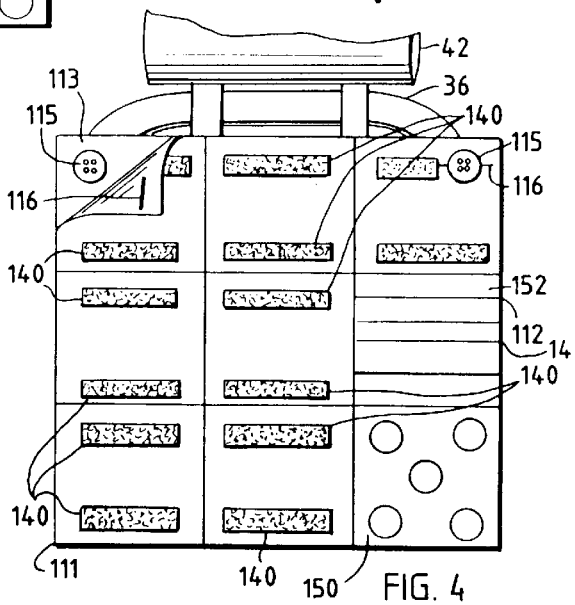
FIG. 4 is a front view of a second preferred embodiment of an amusement center in its folded position without any removably attachable panels installed thereon.

The means for attaching the amusement center 10 to a vehicle seat back may consist of a variety of different fastener options. In one preferred embodiment of the present invention, as shown in FIG. 1, two plastic or metal c-clips 14 are used to attach the amusement center 10 to the rear of a vehicle seat. These c-clips 14 may be provided with a button slot for attachment to two car securement buttons 44 which are shown in side view in FIG. 2. Or, two flexible strips 36 may be provided with hook and loop fasteners such as Velcro to attach the amusement center 10 to a head rest 42, as shown in FIG. 4. FIG. 3 shows yet another form of vehicle securement means in which two elongated Velcro strips 43 are positioned transversely across base flexible cover 32. Corresponding elongated Velcro strips which are adhesive backed may be placed on the back of the vehicle seat to secure amusement center 10 thereto. Of course, the use of adhesive Velcro strips on the back of a vehicle seat may not be particularly desirable to many car owners, and this is probably a fall back vehicle securement means where c-clips 14 cannot attach to a car seat or Velcro strips 36 may not attach to a head rest 42. It may be noted that when elongated Velcro strips 36 are used, neither Velcro strips 36 nor c-clips 14 need be attached to vehicle securement buttons 44.

In the preferred embodiment utilizing the c-clips 14, the c-clips 14 secures amusement center 10 to the vehicle seat by extending around the seat from the front to the back such that the expansion of the clip to encompass the width of a car seat would provide sufficient tension to provide attachment to the seat and support the amusement center 10. Thus, c-clips 14 may be made from metal or plastic or a variety of other rigid or semi-rigid materials which are capable of providing adequate tension to secure amusement center 10 to a vehicle seat.

Referring to FIG. 4 of the present invention is shown a second embodiment of the present invention where the display structure 111 has two haves, a first half 112 and a second half 113 wherein the two halves may be folded together and secured to the vehicle securement means. In this case, the vehicle securement means consists of Velcro strips 36 which are secured about headrest 42. The two halves 112 and 113 are shown folded back upon one another and the folded securement means consists of two buttons 115 which may be placed through corresponding slots 116. This particular view also shows a display structure when all panels have been removed showing exposed Velcro strips 140. This particular view also illustrates how some or all of display structure 111 may be printed with decorative pictures such as printed pictures 150 and 152 and removable panels need not be used. This particular embodiment of amusement center 110 allows the amount of toys and entertainment items to be doubled and it can fold out as a baby entertainment quilt when it is removed from the vehicle.

Figure 5:
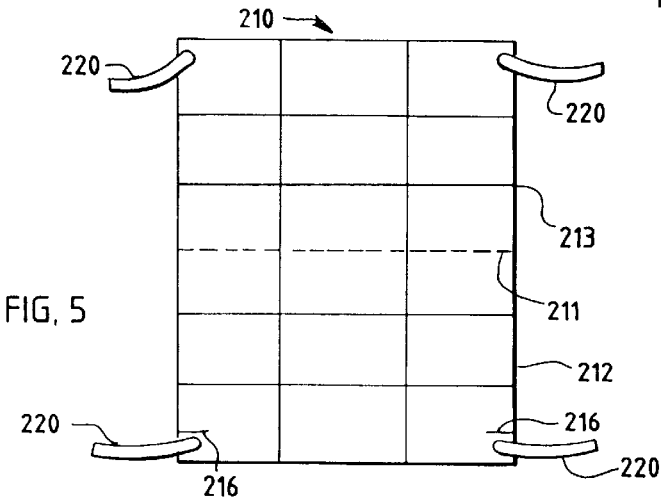
FIG. 5 is a rear view of a third preferred embodiment of an amusement center unfolded.

FIG. 5 shows yet a third embodiment of the present invention, again showing a display structure 211 with a first half 212 and a second half 213, but this particular embodiment has been provided with two pairs of ties 220 so that the display structure 211 can be simply tied together by ties 220 when it is in use in a vehicle, but spread out to double its size so that it may also function as a baby entertainment quilt.

Although in the foregoing detailed description the present invention has been described by reference by various specific embodiments, it is to be understood that modifications and alterations in the structure and arrangement of those embodiments other than those specifically set forth herein may be achieved by those skilled in the art, and that such modification or alterations are to be considered as within the overall scope of this invention.

I claim:

1. An amusement center for rear facing infant child seats comprising:

a thin, flexible display structure;

vehicle attachment means adapted to secure and support the flexible display structure upon a vehicle seat back; and at least one entertainment item with removable attachment means for removably securing the entertainment item to the flexible display structure, the entertainment item comprising an item adapted to provide amusement for an infant.

2. The amusement center of claim 1 wherein the thin flexible display structure comprises a soft, flexible cloth, plastic, vinyl, or polymeric material.

3. The amusement center of claim 1 wherein the flexible display structure comprises a thin, flexible base, a thin flexible cover, and an interior portion of a suitable, cushion material sandwiched therebetween.

4. The amusement center of claim 3 wherein the cushioning material may be made from foam, batting or a fibrous material.

5. The amusement center of claim 1 wherein the flexible display structure comprises a first half, having a first half attachment means attached thereto, and a second half, having a corresponding second half attachment means attached thereto, wherein the first half and second half may be folded in half and secured together by both the first and second half securement means.

6. The amusement center of claim 1 wherein the vehicle attachment means comprises a pair of C-clips.

7. The amusement center of claim 1 wherein the vehicle attachment means comprises a pair of elongated flexible strips for attachment to a headrest.

8. The amusement center of claim 7 wherein the pair of elongated flexible strips are further provided with corresponding hook or loop fasteners on each of the strips.

9. The amusement center of claim 1 wherein the removable attachment means for the entertainment items consist of a plurality of hook or loop fasteners secured to the thin flexible display structure and a plurality of panels with corresponding hook or loop fasteners.

10. The amusement center of claim 9 wherein the plurality of panels further have item securement means such as pockets, ties, loops or minature hook and loop fastening strips for entertainment item securement.

11. The amusement center of claim 9 wherein at least one panel has a decorative picture for entertainment.

* * * * *